United States Patent [19]

Tochtermann

[11] Patent Number: 4,526,648

[45] Date of Patent: Jul. 2, 1985

[54] AIRJET LABEL APPLICATOR

[75] Inventor: Henry Tochtermann, Beecroft, Australia

[73] Assignee: Video Design Pty. Ltd., Beecroft, Australia

[21] Appl. No.: 585,104

[22] Filed: Mar. 1, 1984

[30] Foreign Application Priority Data

Mar. 2, 1983 [AU] Australia ..... PF8265

[51] Int. Cl.[3] ..... B65C 9/14; B65C 9/28; B65H 29/24

[52] U.S. Cl. ..... 156/497; 156/538; 156/572; 156/DIG. 31; 156/DIG. 38; 271/90; 271/194; 271/195

[58] Field of Search ..... 156/285, 497, DIG. 38, 156/538, 556, 572, DIG. 31; 355/87, 91; 271/90, 94, 194, 195; 294/64.1-64.2, 64.3, 65

[56] References Cited

U.S. PATENT DOCUMENTS

| | | | |
|---|---|---|---|
| 1,855,356 | 4/1932 | Koppe | 355/87 |
| 3,888,725 | 6/1975 | French | 156/DIG. 38 |
| 4,028,166 | 6/1977 | Leonhart | 156/497 |
| 4,255,220 | 3/1981 | Kucheck et al. | 156/DIG. 38 |
| 4,390,386 | 6/1983 | Bartl | 156/DIG. 38 |

*Primary Examiner*—Michael Wityshyn
*Attorney, Agent, or Firm*—Ladas & Parry

[57] ABSTRACT

This invention provides a multi-outlet adapter for conversion of at least one source of pressure or vacuum to a multiplicity of outlets of the source(s). The adapter comprises at least two abutting blocks. The pressure and/or vacuum sources are connected to aperture(s) in a surface of the first of the blocks. These aperture(s) terminate in first depression(s) in the opposite face of the first block. The depression(s) in the first block communicate directly with a multiplicity of apertures in the abutting face of the second block which apertures in turn terminate on the opposing face of the second block in a multiplicity of second depressions which constitute the pressure or vacuum outlets.

The adapter has particular application in self-adhesive label applicators in which a third block preferably abuts the second block and comprises a grid formed from a multiplicity of apertures which each communicate with the second depression(s). The grid of apertures thus resolves the outlets into greater detail. The adapter can be programmed by inserting a template adjacent to any surface of one of the blocks other than the first block so as to occlude and concurrently select certain only outlets.

9 Claims, 10 Drawing Figures

AIRJET LABEL APPLICATOR

The present invention relates to a multi-outlet adapter such as is used, for example, in an air jet self-adhesive label applicator.

Although the present invention arises out of the art of self-adhesive labels, it will be apparent that the invention can also be used in a wide variety of applications wherever it is desired to accurately position multiple outlets of pressure and/or vacuum, for example in the lifting of small objects in assembly line situations.

Multi-outlet adapters have been used in, for example, air jet self adhesive label applicators for some time and their operating principle is well known. Self adhesive labels are dispensed from a continuous roll of labels onto the grid plate of a multiple outlet adapter consisting in part of a series of apertures arranged in a regular pattern on the grid plate. The labels are positioned and held in place by preselected appropriate grid apertures which are connected to a vacuum or suction source. When the container to be labelled is in the position to receive its label, a sensing device, such as a photoelectric cell, connects other preselected apertures in the grid to an air pressure source, the air pressure then overcomes the suction holding the label to the grid and blows the self adhesive label onto the container.

The multi-outlet adapters form part of a total automatic labelling system in which the containers to be labelled are moved across the grid plate of the adapter by a conveyor belt and, after being labelled, pass between rollers which more permanently affix the labels to the container by applying pressure to the label. The labels, dispensed from a continuous roll, are usually temporarily affixed to a backing sheet and separated therefrom while being dispensed to the grid plate. Known forms of these adapters have been referred to in Australian Patent Application No. 71962/81.

The prior art adapters work effectively in that they have the facility of selecting the precise area of the grid onto which the labels are dispensed from the continuous roll and from which they are blown to the containers. This is achieved by applying a vacuum source or suction to only certain preselected apertures and an intermittent air pressure source to certain other preselected apertures. The remainder of the apertures are neutralised.

However, the prior art adapters suffer from the disadvantage that the programming of the grid requires each individual aperture in the grid to be separately connected to (a) a vacuum or suction source, (b) an air pressure source or (c) neither, by manually inserting in each aperture on the grid (or some other plate abutting it) some device such as a plug which will make the required selection.

This manual insertion of devices to individual apertures requires a degree of skill and considerable time. In particular, the prior art adapters do not allow rapid reprogramming of the grid to accommodate different size and/or shaped labels.

It is an object of the present invention to substantially overcome or ameliorate this disadvantage of the prior art multi-outlet adapters.

Accordingly, in one broad form this invention provides a multi-outlet adapter for conversion of at least one source of pressure or vacuum to a multiplicity of outlets of said source, said adapter comprising at least two blocks having opposed mating surfaces, said at least one source being connected to the surface of said first block opposite said mating surface, the mating surface of said first block having a first depression therein extending substantially in a first direction, said depression communicating directly to the connection of said at least one source to said opposite surface; the mating surface of said second block having a plurality of apertures therein which, when said mating surfaces are abutted, all communicate with said first depression; the surface of said second block opposite said mating surface having a plurality of second depressions therein each corresponding to, and communicating with, one of said apertures and each extending in a direction substantially mis-aligned with said first direction, said second depressions constituting said multiplicity of outlets.

It will be apparent that according to this broad form the preselection of outlets results from the design of the second block and in particular the arrangement of the plurality of second depressions therein. It will also be apparent that, in this broad form, connection need only be made to, for example, a vacuum source, in the first block so as to position and hold an object on the second depressions. Release of the object from the adapter could result from temporarily interrupting the vacuum source and thus allow the positioned object to be released therefrom by gravitational or other force.

It is preferred that the adapter has a third block with a third surface which mates with said opposite surface of said second block when said second and third blocks are abutted, said third block having an array of openings therethrough at predetermined locations which each communicate said third surface with another surface of said third block, at least some of said openings being aligned with said second depressions and said some openings constituting said multiplicity of outlets.

It will be apparent that this preferred embodiment will result in greater definition of the outlet pattern to more accurately position an object thereon.

When the adapter is embodied in an air-jet applicator, for example, it is preferred that the adapter has at least one source of pressure and at least one source of vacuum, said mating surface of said first block having a first depression for each pressure source and a first depression for each vacuum source, all said first depressions being generally aligned, the apertures in said second block each communicating with only one of said first depressions to create second pressure depression(s) and second vacuum depression(s) respectively and some of said openings in said third block communicating with said second pressure depression(s) whilst the remainder of said openings in said third block communicate with said second vacuum depression(s).

It is also preferred that the adapter is adapted to receive a template adjacent to any surface of a block other than the first block to occlude some or all of the outlets.

By way of example only, one embodiment of the multi-outlet adapter will now be described with reference to the accompanying drawings in which.

Figure 10:
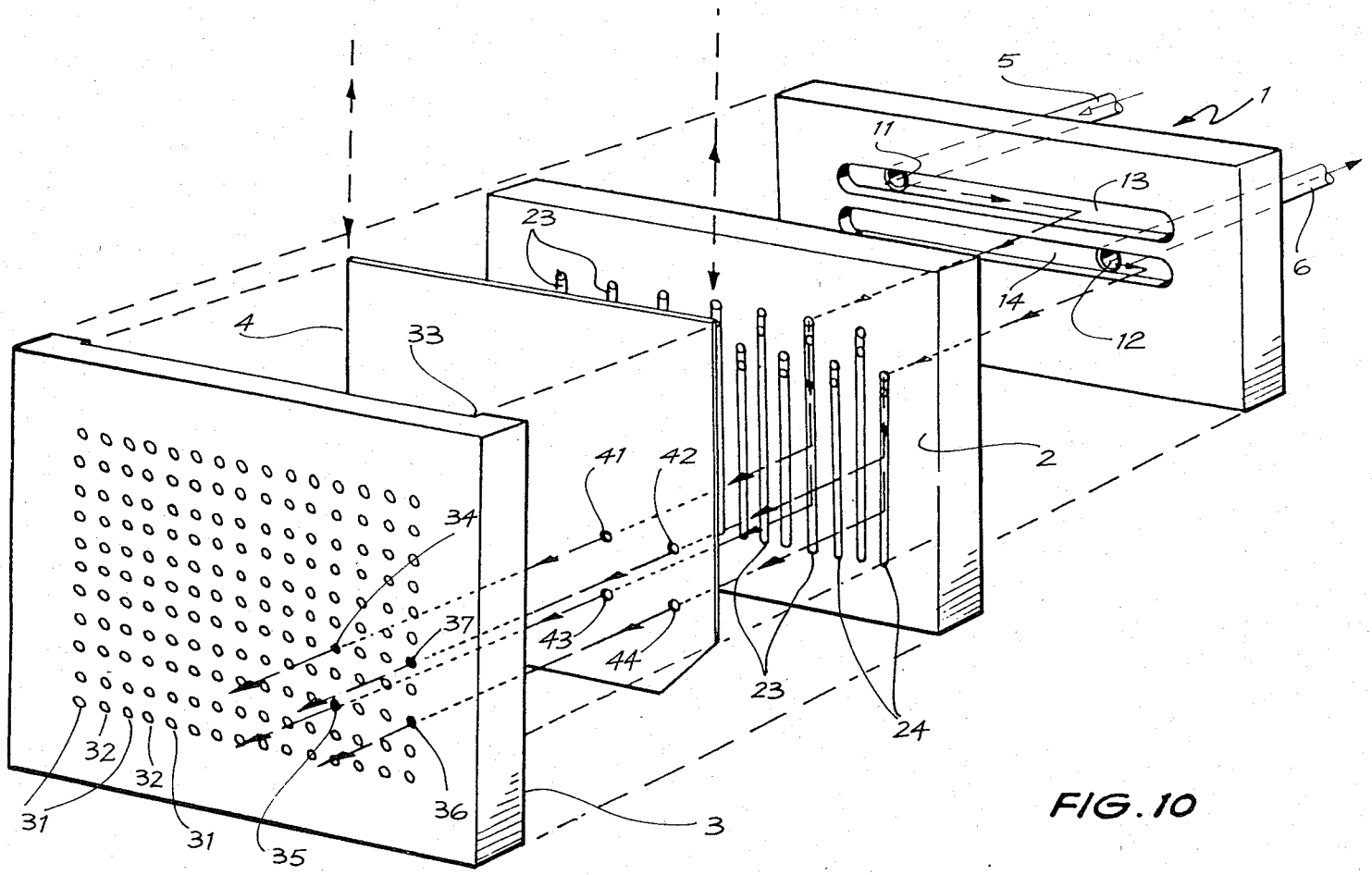
FIG. 10 is an exploded perspective view of the assembled plates.

As can best be appreciated from FIG. 10, a preferred embodiment of an adapter used as a label applicator comprises three abutting plates viz. a manifold plate 1, a supply plate 2 and a grid plate 3. A template 4 is inserted between the supply plate 2 and the grid plate 3.

An air pressure source 5 and a vacuum source 6 are applied to two manifold apertures 11 and 12, respectively, of the manifold plate 1. The manifold apertures 11 and 12 terminate on the opposite side, of the manifold plate 1 in manifold slots 13 and 14.

The supply plate 2 has a plurality of supply apertures 21,22 and abuts the face of the manifold plate 1 having the manifold slots 13 and 14 therein, such that the supply apertures 21 and 22 are aligned with and completely covered by the manifold slots 13 and 14 respectively to thereby be in fluid communication therewith.

The supply apertures 21 and 22 are mutually offset so that they respectively terminate in two sets of substantially parallel supply slots 23 and 24, on the opposite face of the supply plate 2. It can therefore be appreciated that if air pressure is applied to the manifold aperture 11 and vacuum is applied to the manifold aperture 12, then the first, third, fifth, etc. supply slots 24 will be outlets of vacuum whilst the intervening second, fourth, sixth, etc. supply slots 23 will be outlets of air pressure.

Accordingly, as the grid plate 3 abuts the face of the supply plate 2 having the supply slots 23 and 24 therein, such that the grid apertures 31,32 are aligned with and completely covered by the supply slots 23,24, then the first, third, fifth, etc. columns of grid apertures 31 will be outlets of vacuum whilst the intervening second, fourth, sixth, etc. columns of grid apertures 32 will be outlets of air pressure.

It will be apparent that the embodiment does not require that the manifold slots 13,14 be horizontal as disclosed by the present example since they can be at any angle to the horizontal, provided that alignment of the openings in the three abutting plates is maintained.

Figure 1:
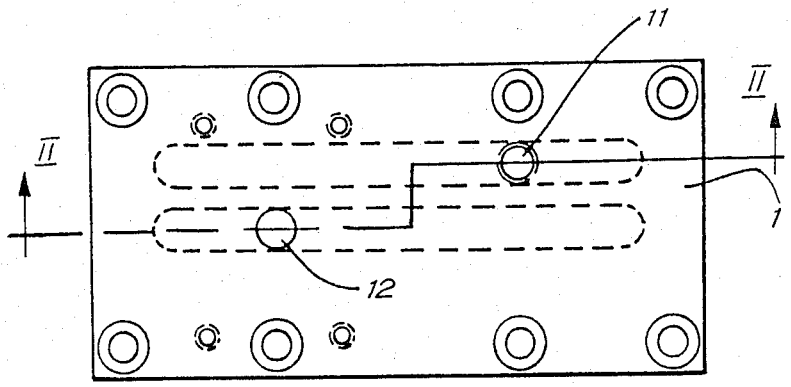
FIG. 1 is a front elevation of a first block, or manifold plate, the illustrated face of which can be connected to vacuum and air pressure sources.
Figure 2:
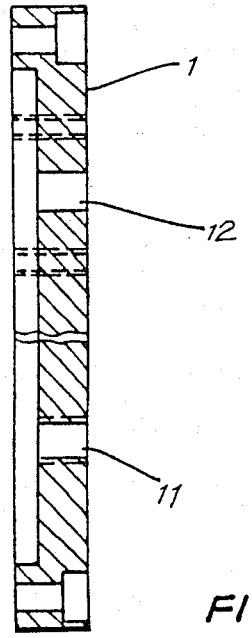
FIG. 2 is a longitudinal cross-section through the manifold plate along the line II—II of FIG. 1.
Figure 3:
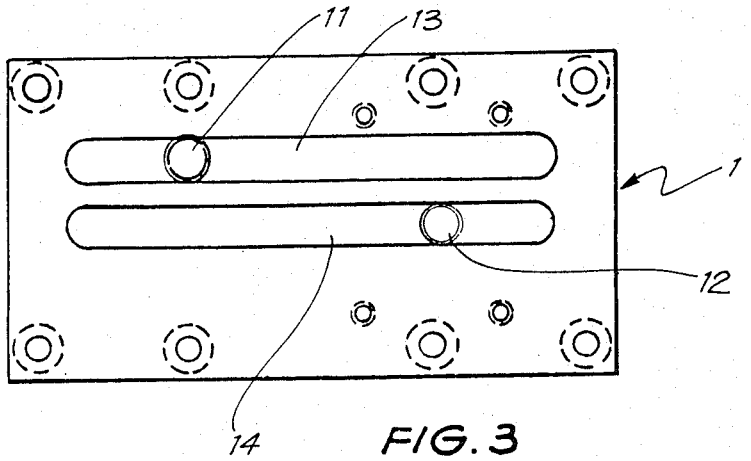
FIG. 3 is a front elevation of the manifold plate face opposite to that illustrated in FIG. 1 and which abuts a second block, a supply plate.
Figure 4:
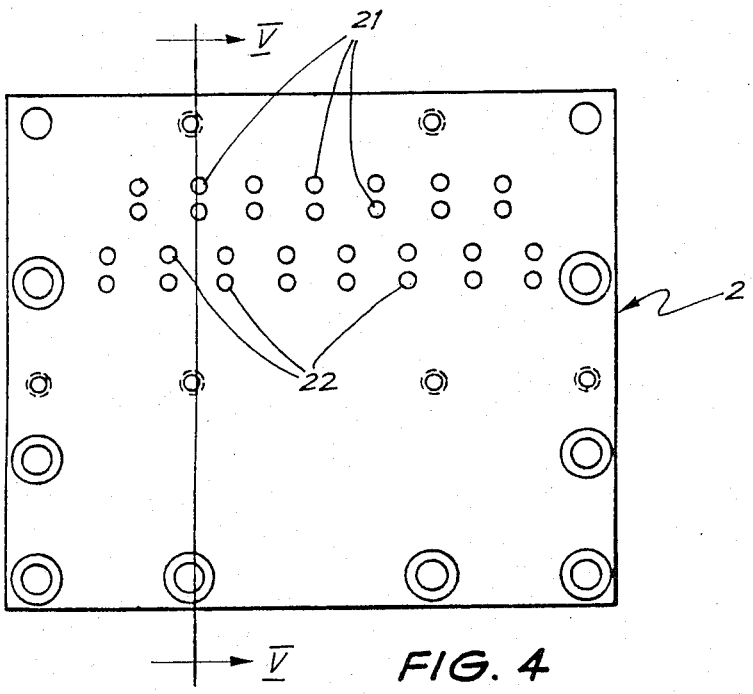
FIG. 4 is a front elevation of the abutting face of the supply plate.
Figure 5:
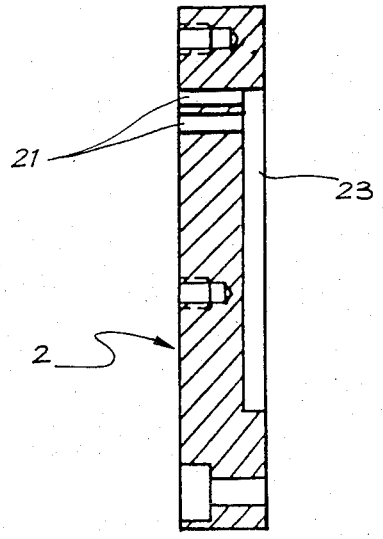
FIG. 5 is a transverse cross-section along the line V—V of FIG. 4.
Figure 6:
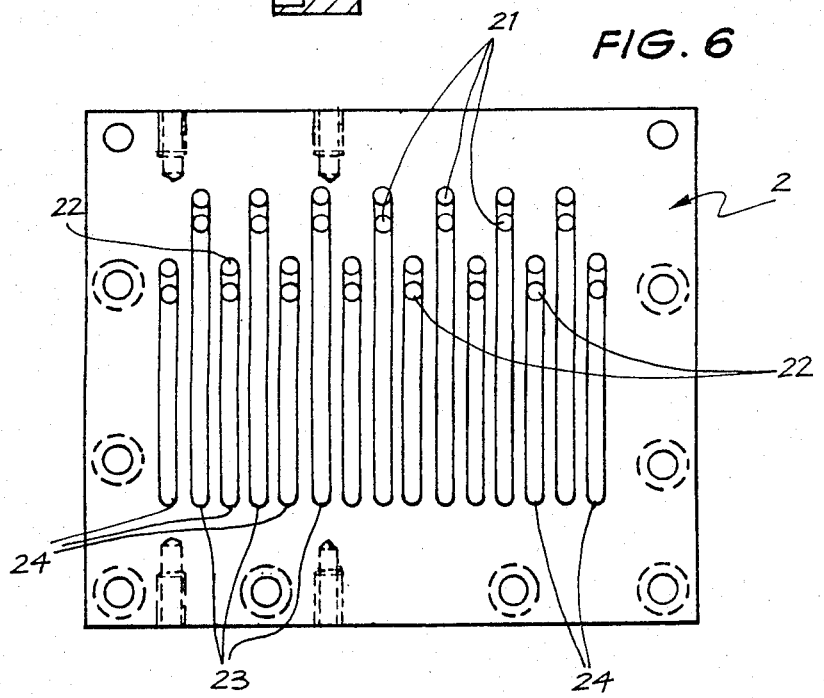
FIG. 6 is a front elevation of the face of the supply plate of FIG. 4 which is opposite the abutting face.
Figure 7:
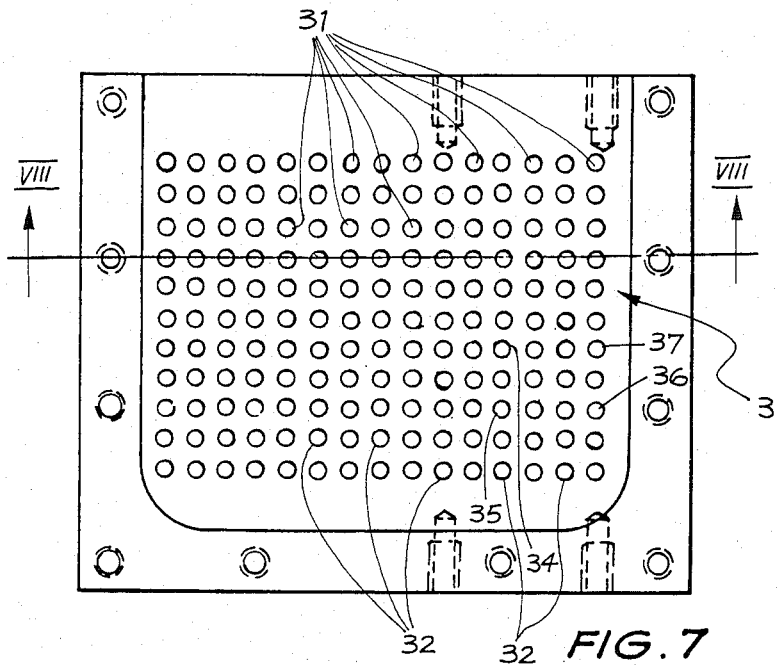
FIG. 7 is a rear elevation of a grid plate.
Figure 8:
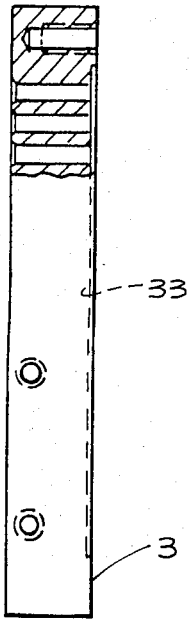
FIG. 8 is a longitudinal cross-section along the line VIII—VIII of FIG. 7.
Figure 9:
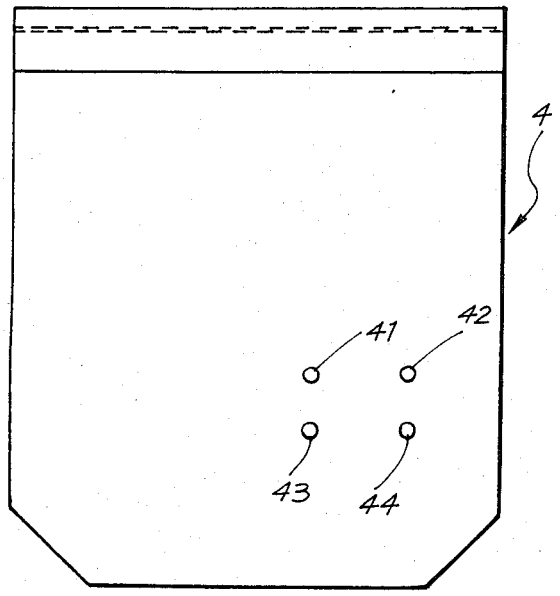
FIG. 9 is a front or rear elevation of a typical template, the rear elevation being identical.

As can be seen from FIG. 8 a recess 33 allows for insertion of a thin template 4 between the supply plate 2 and the grid plate 3 so as to completely cover the grid apertures 31 and 32. This template 4, if not perforated at all, would completely occlude all the grid apertures 31 and 32. By way of example only, and assuming air pressure is applied to the manifold aperture 11 and vacuum is applied to manifold aperture 12, FIG. 9 shows a template 4 with four apertures 41, 42, 43 and 44. When this template is inserted in recess 33 then the grid apertures 36 and 37 are connected to the vacuum source 6, the grid apertures 34 and 35 are connected to the air pressure source 5. The remaining grid apertures are not connected to either source.

This arrangement results in a label (not illustrated), for example, being held to the grid plate 3 by the vacuum outlets at the apertures 36 and 37. A suitable known (not illustrated) device, sensing that a container to be labelled is in position adjacent the grid plate 3, then applies a burst of air pressure to manifold aperture 11 and therefore to apertures 34 and 35, the burst of air pressure being of sufficient strength to overcome the vacuum at apertures 36 and 37. In consequence the label is applied to the container.

It will be apparent that this embodiment describes a method whereby it is a relatively simple task to prepare various templates 4 for variously dimensioned and sized labels and it will also be apparent that it is a very simple task to reprogramme the applicator by replacement of one template 4 with another.

It is evident, that those skilled in the art, once given the benefit of the foregoing disclosures, may now make numerous other uses and modifications of, and departures from, the specific embodiments described herein without departing from the inventive concepts.

What I claim is:

1. A multi-outlet adapter for conversion of one source of pressure and one source of vacuum to two respective sets of outlets each said set having a multiplicity of openings, said adapter comprising three abutting blocks having opposed mating surfaces, said pressure and vacuum sources being connected to one surface of said first block other than the mating surface of said first block, said first block mating surface having a pair of first depressions therein extending substantially in a first direction, each said first depression communicating directly to a connection of a corresponding one of said sources; one mating surface of said second block having two sets of apertures therein with each set having a plurality of apertures, the apertures of each said set of apertures all communicating with a corresponding one of said first depressions, the other mating surface of said second block having two sets of second depressions therein each of which correspond to, and communicate with, one of said sets of apertures, each set of second depressions having a plurality of said second depressions which each extend in a second direction substantially mis-aligned with said first direction; and said third block having an array of said openings therethrough at predetermined locations with each communicate the mating surface of said third block with another surface of said third block, at least some of said openings being aligned with said second depressions of one said set of second depressions and the remainder of said openings being aligned with said second depressions of the other set of said second depressions, said some openings constituting one said set of outlets and said remainder of said openings constituting the other said set of outlets.

2. An adapter as claimed in claim 1 wherein the communicating apertures in said blocks lie on substantially straight lines.

3. An adapter as claimed in claim 1 wherein a template is insertable adjacent to any mating surface of a block other than said first block to occlude some or all of said outlets.

4. An adapter as claimed in claim 3 wherein said template is insertable between said second and third blocks.

5. An adapter as claimed in claim 1 wherein each of said first depressions is an elongate slot.

6. An adapter as claimed in claim 1 wherein each of said second depressions is an elongate slot.

7. An adapter as claimed in claim 1 wherein said first direction is substantially perpendicular to said second direction.

8. An adapter as claimed in claim 1 wherein said array of openings is a substantially rectangular array.

9. An air-jet label applicator including an adapter as claimed in claim 1.

* * * * *